US006651299B2

(12) United States Patent
Mitsubayashi et al.

(10) Patent No.: US 6,651,299 B2
(45) Date of Patent: Nov. 25, 2003

(54) METHOD AND APPARATUS FOR MANUFACTURING ENDLESS METALLIC BELT, AND THE ENDLESS METALLIC BELT MANUFACTURED BY THE METHOD

(75) Inventors: Masahiko Mitsubayashi, Nagoya (JP); Masazumi Onishi, Toyota (JP); Hideo Aihara, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 99 days.

(21) Appl. No.: 09/971,621

(22) Filed: Oct. 9, 2001

(65) Prior Publication Data

US 2002/0042977 A1 Apr. 18, 2002

(30) Foreign Application Priority Data

Oct. 13, 2000 (JP) ..... 2000-312829
Nov. 14, 2000 (JP) ..... 2000-346328

(51) Int. Cl.[7] ..... B21C 37/30

(52) U.S. Cl. ..... 29/90.7; 29/407.05; 29/707; 29/714; 72/53; 474/272

(58) Field of Search ..... 29/90.7, DIG. 36, 29/407.01, 407.05, 707, 714; 72/53, 54, 56; 474/272

(56) References Cited

U.S. PATENT DOCUMENTS 1,116,776 A * 11/1914 Wilcox ..... 29/DIG. 36
2,422,431 A * 6/1947 Melrose ..... 29/DIG. 36
2,661,643 A * 12/1953 Olson ..... 72/53
3,000,425 A * 9/1961 Hodges et al. ..... 72/53
4,350,035 A * 9/1982 Kopp et al. ..... 72/53
5,063,015 A * 11/1991 Lloyd et al. ..... 451/39
5,072,606 A * 12/1991 Koehler et al. ..... 29/90.7
5,212,976 A * 5/1993 Company ..... 29/90.7
5,266,769 A * 11/1993 Deshpande et al. ..... 451/57
5,771,729 A * 6/1998 Bailey et al. ..... 29/90.7
2002/0019283 A1 * 2/2002 Mitsubayashi et al. ..... 474/272

FOREIGN PATENT DOCUMENTS

| | | |
|---|---|---|
| EP | 0 181 670 A1 | 5/1986 |
| JP | A 61-42402 | 2/1986 |
| JP | A-61-42402 | 2/1986 |
| JP | A 63-96258 | 4/1988 |
| JP | A-2000-225567 | 8/2000 |

* cited by examiner

*Primary Examiner*—David P. Bryant
(74) *Attorney, Agent, or Firm*—Oliff & Berridge, PLC

(57) ABSTRACT

A method and apparatus of manufacturing an endless metallic belt adjusts a circumferential length of the belt by subjecting the endless metallic belt to a shot peening treatment. For example, by measuring the circumferential length prior to the shot peening treatment and determining the condition of the shot peening treatment on the basis of the measured length, and/or by measuring the circumferential length during the shot peening treatment and terminating the shot peening treatment on the basis of the measured length.

22 Claims, 12 Drawing Sheets

METHOD AND APPARATUS FOR MANUFACTURING ENDLESS METALLIC BELT, AND THE ENDLESS METALLIC BELT MANUFACTURED BY THE METHOD

INCORPORATION BY REFERENCE

The disclosures of Japanese Patent Applications Nos. 2000-312829 filed on Oct. 13, 2000 and 2000-346328 filed on Nov. 14, 2000, each including the specification, drawings and abstract, are incorporated herein by reference in their entirety.

BACKGROUND OF THE INVENTION

1. Field of Invention

The present invention relates to a method of manufacturing an endless metallic belt, an apparatus for manufacturing the endless metallic belt, and the endless metallic belt manufactured by the method. The present invention is applicable to the manufacture of an endless metallic belt of a CVT (continuously variable transmission) such that the belt has a high degree of accuracy in its circumferential length.

2. Description of Related Art

An endless metallic belt is mounted on two rollers for traveling. When traveling on a roller, the belt is subjected to a tensile bending stress at its outer peripheral surface. When leaving the roller toward the next roller, the belt is straightened and is relieved of the tensile stress at the outer peripheral surface resulting from bending. During traveling, the outer peripheral surface of the belt is thus repeatedly subjected to the tensile stress by bending. It is therefore desired to improve fatigue strength of the belt against such repeated tensile stresses.

Japanese Patent Laid-Open Publication Nos. 61-42402 and 63-96258 propose an endless metallic belt with improved fatigue strength at its outer peripheral surface. More specifically, only the outer peripheral surface of the endless metallic belt is subjected to shot peening so as to produce a compressive residual stress at the outer peripheral surface, thereby improving the fatigue strength.

In an endless metallic belt formed from a thin metallic sheet, a plastic-deformation layer formed adjacent to each of the outer and inner circumferential surfaces has a thickness (e.g., about 20–25 (m) which is not negligible in view of a relatively small entire thickness (e.g., about 0.2 mm) of the belt. Accordingly, the endless metallic belt suffers from undesirable changes in its overall configuration, for instance, an increase (e.g., about 2 mm) of its circumferential length (e.g., about 720 mm), and a change of its crowing value R. The crowing value R is represented by a radius of curvature of the belt in cross section in a plane perpendicular to the circumferential direction, as indicated in cross sectional view of FIG. 1B, which is taken along line 1B—1B in the perspective view of FIG. 1A.

The endless metallic belt is usually required to have high geometrical and dimensional accuracies with respect to the circumferential length and crowing value R. However, the shot peening treatment, if applied to the endless metallic belt, causes a variation in the dimensional accuracy, which is added to a variation in the dimensional accuracy of the belt prior to the shot peening treatment, giving rise to a functional problem of the belt as the end product.

The accuracy of the circumferential length of the endless metallic belt is extremely important, particularly where the belt as the end product is a multi-layered belt consisting of a multiplicity of endless metallic layers (e.g., nine layers). Where the tolerance of a gap or clearance between the adjacent layers is 10 $\mu$m, for example, the tolerance of a variation of the circumferential length of the belt is about 60 $\mu$m, which is $2\pi$ times the tolerance of the gap.

In the shot peening treatment, the shot peening intensity (defined by ejection velocity and density of shot peening particles) is instable in the initial and terminal periods of the shot peening operation. A variation or fluctuation in the shot peening intensity in the shot peening cycle causes local deterioration of the geometrical and dimensional accuracies of the belt such as a local variation of the circumferential length and a local variation of the crowing value R (radius of curvature in cross section perpendicular to the circumferential direction), since the endless metallic belt has a small thickness and is easily deformable, and since the shot peening operation is performed while the belt is rotating.

The local deterioration of the geometrical and dimensional accuracies of the endless metallic belt is further caused by a variation in the rotating speed of the belt during the shot peening treatment. Where the endless metallic belt during the shot peening treatment slips on rollers used for the shot peening treatment, the geometrical and dimensional accuracies of the belt have particularly large local variations.

Thus, an apparatus for manufacturing an endless metallic belt as disclosed in the above-identified publications suffers from relatively low reliability in terms of the geometrical and dimensional accuracies of the belt.

In view of the drawback indicated above, a multiplicity of endless metallic layers are prepared for manufacturing a multi-layered endless metallic belt, by assembling selected ones of those endless metallic layers, such that the circumferential lengths of the selected layers have a difference within a predetermined range of tolerance. However, this method requires a large volume of stock of the endless metallic layers, and suffers from extremely low manufacturing efficiency.

SUMMARY OF THE INVENTION

It is therefore an object of this invention to provide a method of manufacturing an endless metallic belt, which assures improved accuracy of the circumferential length of the belt while having a shot peening treatment applied thereto, which is conventionally a source of deterioration of the dimensional accuracy of the belt. Other objects of the invention are to provide an apparatus suitable for practicing the method, and the improved endless metallic belt manufactured by the method.

According to a first aspect of the present invention, there is provided a method of manufacturing an endless belt, comprising applying a shot peening treatment to the endless metallic belt, wherein the shot peening treatment includes a condition of the shot peening treatment is adjust to adjust a circumferential length of the endless metallic belt.

The method according to the first aspect of this invention permits improved efficiency in manufacturing of the endless metallic belt with improved accuracy of its circumferential length, owing to the adjustment of the circumferential length by adjusting the condition of the shot peening treatment (for example, adjustment of the shot peening time).

Since the present method permits the adjustment of the circumferential length of each belt by adjusting the condition of the shot peening treatment, the endless metallic belt manufactured by this method can be suitably used as each element of a multilayered endless metallic belt including multiple elements in the form of multiple endless metallic layers. Therefore, this method permits improved efficiency in manufacturing of such a multi-layered endless metallic belt, without maintaining a large volume of stock of endless metallic layers as required in the prior art (which requires selection of a group of endless metallic layers whose circumferential lengths are almost equal to each other).

In accordance with the invention, the improved endless metallic belt can be manufactured by the method described above.

Further, the method described above can be practiced, for example, by an apparatus comprising: at least two rollers upon which the endless metallic belt rotates in tension; an ejection nozzle that ejects shot peening particles against the endless metallic belt during rotation of the endless metallic belt during a shot peening treatment; and an instrument that measures a variation of a circumferential length of the endless metallic belt during the shot peening treatment. Alternatively, the method can be practiced by an apparatus comprising: at least two rollers upon which the endless metallic belt rotates in tension; an ejection nozzle that ejects shot peening particles against the metallic belt during rotation of the endless metallic belt during a shot peening treatment; and a blocking mechanism that prevents the shot peening particles from striking the endless metallic belt.

BRIEF DESCRIPTION OF THE DRAWINGS

The above and other objects, features, advantages, and technical and industrial significance of this invention will be better understood by reading the following detailed description of presently preferred embodiments of the invention, when considered in connection with the accompanying drawings, in which.

DETAILED DESCRIPTION OF PREFERRED EMBODIMENTS

FIGS. 1–12 describe the method and apparatus for manufacturing an endless metallic belt.

First, the principle of the present invention common to all of the embodiments discussed below will be explained. In the method of manufacture of an endless metallic belt according to the present invention, a thin metallic strip is welded at its opposite ends to form the endless metallic belt 6. For example, the endless metallic belt 6 is formed of a maraging steel, and has a thickness of about 0.2 mm, a width of about 12 mm, and a circumferential length of about 720 mm.

Then, the endless metallic belt 6 is subjected to a surface hardening treatment such as a nitriding or soft nitriding treatment. By this treatment, the endless metallic belt 6 is provided with a nitrided layer having a thickness of about 25 $\mu$m, for example.

Subsequently, the endless metallic belt 6 is subjected to a shot peening treatment, to improve its fatigue strength. If an endless metallic belt were subjected to a shot peening treatment at its outer circumferential surface only, the belt would be significantly deformed in a multiple-hoop state, or would suffer from multiple-hoop deformation, as indicated at 6' in FIG. 12. To avoid this multiple-hoop deformation, the endless metallic belt 6 is subjected at both of the inner and outer circumferential surfaces to the shot peening treatment, according to the principle of this invention. It is preferable to effect so-called "stress peening" in which the endless metallic belt 6 is subjected to the shot peening treatment in a pre-stressed state, namely, while a preload in the form of a tensile stress is applied to the surface of the belt 6. However, the stress peening is not essential. For example, the shot peening treatment is effected in the following condition:

Preloading radius of curvature R: 20 mm

Ejection air pressure: 0.3 Mpa

Diameter of shot peening particles: 70 $\mu$m

Hardness of shot peening particles: HV700

The shot peening condition is the same for the inner and outer circumferential surfaces of the endless metallic belt 6.

The circumferential length of the endless metallic belt 6 can be finely adjusted by suitably controlling the specific shot peening condition (e.g., shot peening time, ejection air pressure, amount of the shot peening particles, diameter and hardness of the shot peening particles), in particular, the shot peening time.

Figure 1A:
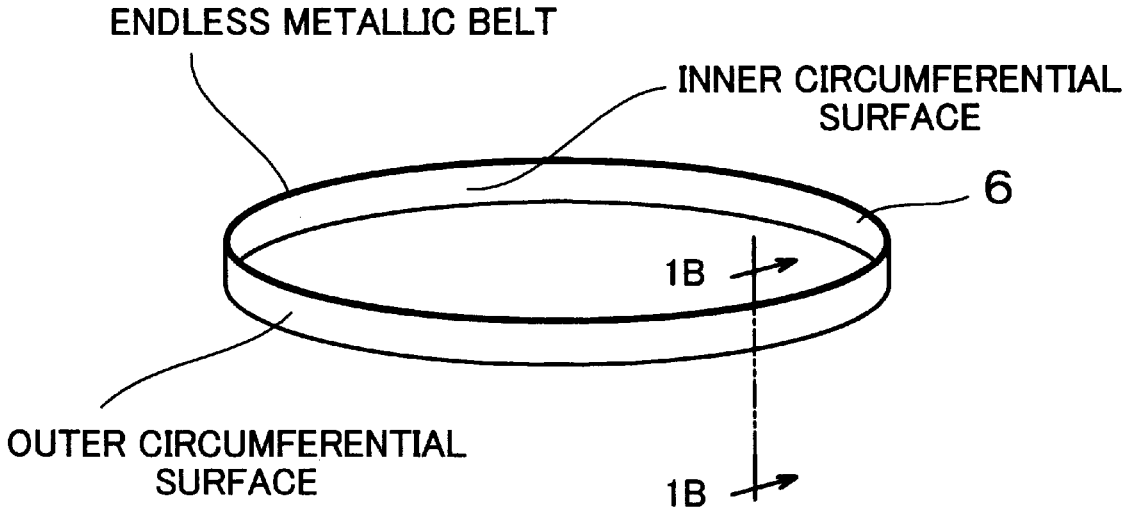
FIG. 1A illustrates a perspective view of an endless metallic belt.
Figure 1B:
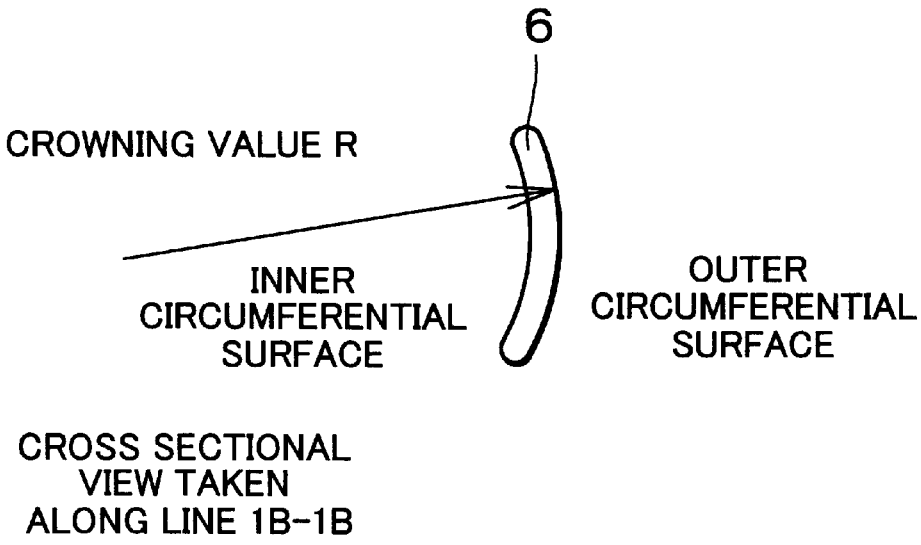
FIG. 1B illustrates a cross sectional view of the endless metallic belt taken along line 1B—1B of FIG. 1A.
Figure 2:
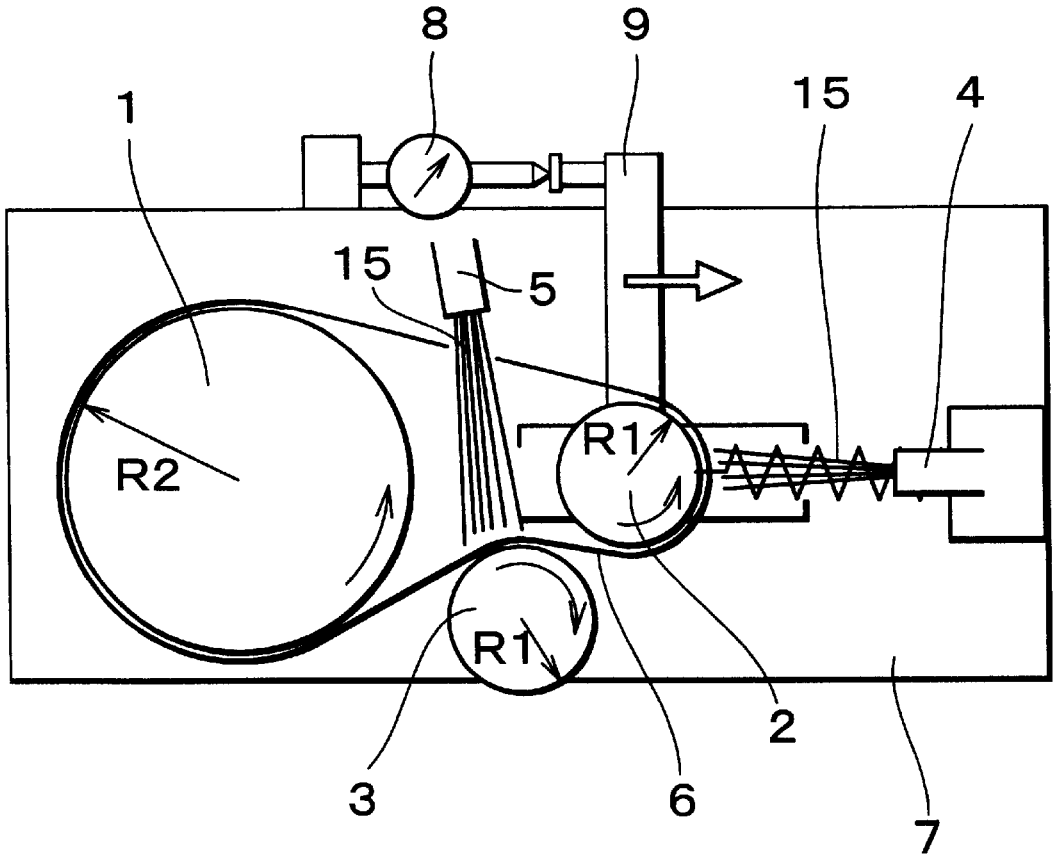
FIG. 2 illustrates a plan view of an apparatus performing a method of manufacturing to the endless metallic belt according to a first embodiment of the present invention.
Figure 3:
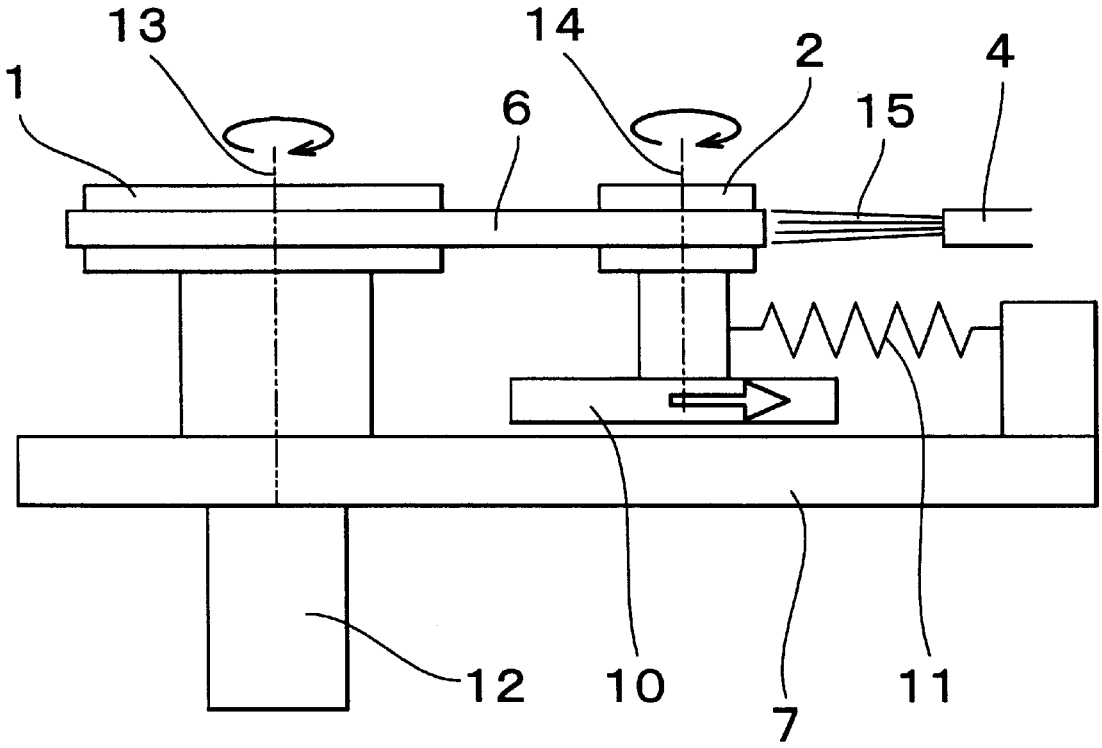
FIG. 3 illustrates a front elevational view of the apparatus of FIG. 2.

The shot peening treatment is effected by an apparatus shown in FIGS. 2 and 3, which includes a drive roller 1, a first driven roller 3 and a second driven roller 2. The first driven roller 3 is provided to apply a preload in the form of a tensile stress to the inner circumferential surface of the endless metallic belt 6, while the second driven roller 2 is provided to apply the preload to the outer circumferential surface. The apparatus further includes an ejection nozzle 5

(auxiliary ejection nozzle for ejecting shot peening particles 15 against a portion of the inner circumferential surface of the endless metallic belt 6, which portion is in contact with the first driven roller 3), and an ejection nozzle 4 (main ejection nozzle) for ejecting the shot peening particles 15 against a portion of the outer circumferential surface of the belt 6, which portion is in contact with the second driven roller 2. On the first driven roller 3, the belt 6 is bent along a curve in one direction opposite to the direction in which the belt 6 is bent on the second driven roller 2, so that the tensile stress is applied to the inner circumferential surface of the belt 6 at the first driven roller 3, and at the outer circumferential surface at the second driven roller 2. The ejection nozzles 4, 5 for the outer and inner circumferential surfaces of the belt 6 are operable independently of each other for controlling the shot peening operations at controlled timings.

The auxiliary ejection nozzle 5 is located and oriented so that the path of ejection of the shot peening particles 15 between the ejecting end of the ejection nozzle 5 and the portion of the belt 6 in contact with the first driven roller 3 is inclined either upwards or downwards by a suitable angle θ, for example 30°, with respect to the horizontal plane, in order to prevent an interference of the shot peening particles 15 with a portion of the belt 6 which is generally opposed to the portion in contact with the first drive roller 3 and which is located between the ejection nozzle 5 and the first driven roller 3. For maximizing an effective component V cos θ of an ejection velocity V of the shot peening particles 15, it is desirable to minimize the inclination angle θ of the ejection path of the shot peening particles 15, while avoiding the above-indicated interference of the shot peening particles 15 with the belt 6. Where the apparatus is capable of ejecting the shot peening particles 15 at a sufficiently high velocity V from the nozzle 5, it is not necessary to limit the inclination angle θ.

The endless metallic belt 6 is given a suitable tension by a spring 11, to generate a force of friction between the belt 6 and the drive roller 1, which is sufficient to prevent slipping of the belt 6 on the drive roller 1 and is considerably smaller than the preload applied by the driven rollers 2, 3 to the belt 6. The second driven roller 2 is rotatably mounted on a movable base 10 which is connected to the spring 11, as shown in FIG. 3, so that the biasing force of the spring 11 acts on the belt 6 as a tensile force. (The movable base 10 can move so as to slide.) The first driven roller 3 at the position at which the belt 6 is subjected to the shot peening treatment at its inner circumferential surface is rotatably mounted and fixed on a stationary base 7 on which a drive shaft 13 for the drive roller 1 is mounted. The drive shaft 13 is driven by a servomotor 12. Where the required geometrical and dimensional accuracies of the belt 6 as the end product are not so high, the servomotor 12 may be replaced by a motor of any other conventional type. The nozzles 4, 5 are connected to an ejection mechanism of direct-pressure air-blow type (not shown). However, the ejection mechanism may be of ventilation air-blow type, impeller type or any other type.

In the present embodiment, the endless metallic belt 6 is subjected to the so-called "stress peening", that is, the shot peening treatment effected which the belt 6 is in a pre-stressed state with a preload in the form of a tensile stress being applied thereto. However, the shot peening treatment need not be the stress peening.

Figure 6:
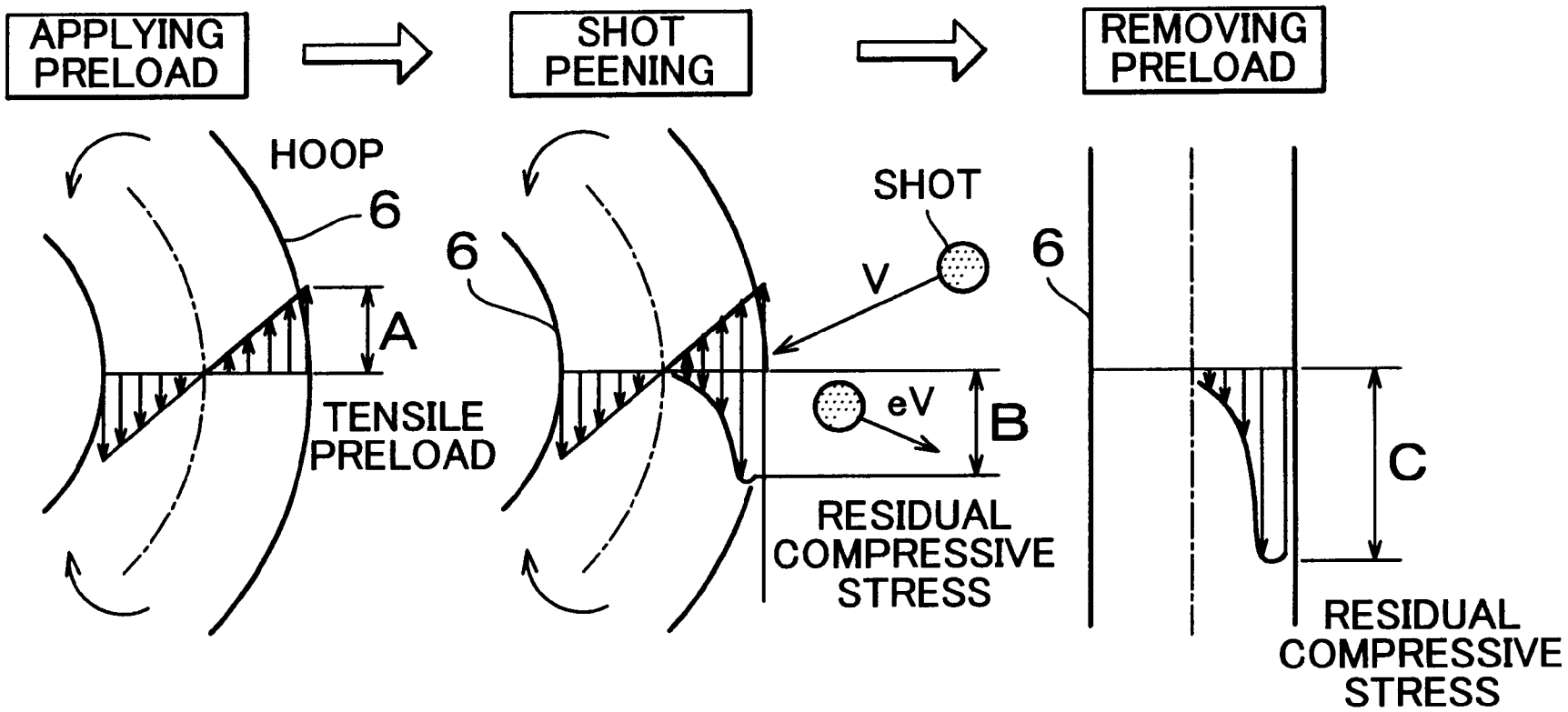
FIG. 6 is a view illustrating distributions of a stress in the direction of thickness of the endless metallic belt in each of a step of applying a preload, a step of performing a shot peening treatment and a step of removing the preload, in the method of manufacture in the first and second embodiments.

The principle of the stress peening will be explained by reference to FIG. 6.

When a portion of the endless metallic belt 6 travels on each roller 1, 2, 3, that portion is bent, and a preload A acts as a tensile stress on the outer side of the bend, and as a compressive bending stress on the inner side of the bend. In this pre-stressed state, the belt 6 is subjected to the shot peening treatment. The shot peening particles 15 are ejected against the portions of the belt 6 on which the tensile bending stress acts. In FIG. 6, "V" and "eV" represent the ejection velocity and a rebound velocity of the shot peening particles 15. A surface portion of the belt 6 against which the shot peening particles 15 have been ejected is elongated, and a residual compressive stress B is generated in the elongated surface portion. The portion of the belt 6 which has been subjected to the shot peening treatment and which has left the roller 1, 2, 3 is then made straight, and the preload in the form of the tensile bending stress is removed from that straight portion. As a result, a compressive bending stress corresponding to the removed tensile bending stress A is added to the residual compressive stress B, so that a larger residual compressive stress C which is a sum of the stresses A and B is generated. In the stress peening, therefore, the larger generated residual compressive stress is larger by the amount corresponding to the tensile preload A, than in the conventional shot peening treatment in which the tensile preload A is not applied to the belt 6. Accordingly, the fatigue strength of the belt 6 subjected to the stress peening according to the present invention is advantageously improved.

For fine adjustment of the endless metallic belt 6, a change in the circumferential length of the belt 6 is measured on the basis of a distance between the axes of the drive shaft 13 and a driven shaft 14 for the second driven roller 2. In particular, an arm 9 is fixed on the movable base 10, and a distance of movement of the arm 9 is measured by a dial indicator 8 fixed on the stationary base 7. A reading of the dial indicator 8 is obtained as an electric signal.

In a second embodiment of the invention described later, the arm 9 and the dial indicator 8 cooperate to constitute a measuring device for measuring the change of the circumferential length of the endless metallic belt 6. This measuring device may be arranged to measure a rate of change of the circumferential length, or directly measure the amount of change of the circumferential length. Where the rate of change of the circumferential length is measured, the amount of change of the circumferential length can be obtained by integrating the rate of change with respect to time, or on the basis of the rate of change and acceding to a predetermined relationship between the rate of change and the amount of change. This relationship is represented by a stored data map.

According to the present invention, the shot peening treatment not only permits an improvement in the fatigue strength of the belt 6, but also improves fine adjustment of the circumferential length of the belt 6.

An endless metallic belt that required to exhibits a relatively high strength is generally subjected to a surface hardening treatment such as a nitriding treatment and a soft nitriding treatment. However, the surface hardening treatment tends to cause a variation in the circumferential length of the belt 6 with respect to the average value (i.e., 720 mm). It is difficult to hold the variation within 0.02% of the average circumferential length of 720 mm, namely, within 0.144 mm.

If the conventional adjustment of the circumferential length of the belt 6 is effected, for example, by pulling the belt 6 to eliminate the variation after the surface hardening treatment the belt 6, the belt 6 may suffer from cracking of the hardened layer adjacent to its surface or removal of the residual compressive stress, resulting in a considerable amount of reduction of the strength of the belt 6.

Figure 4:
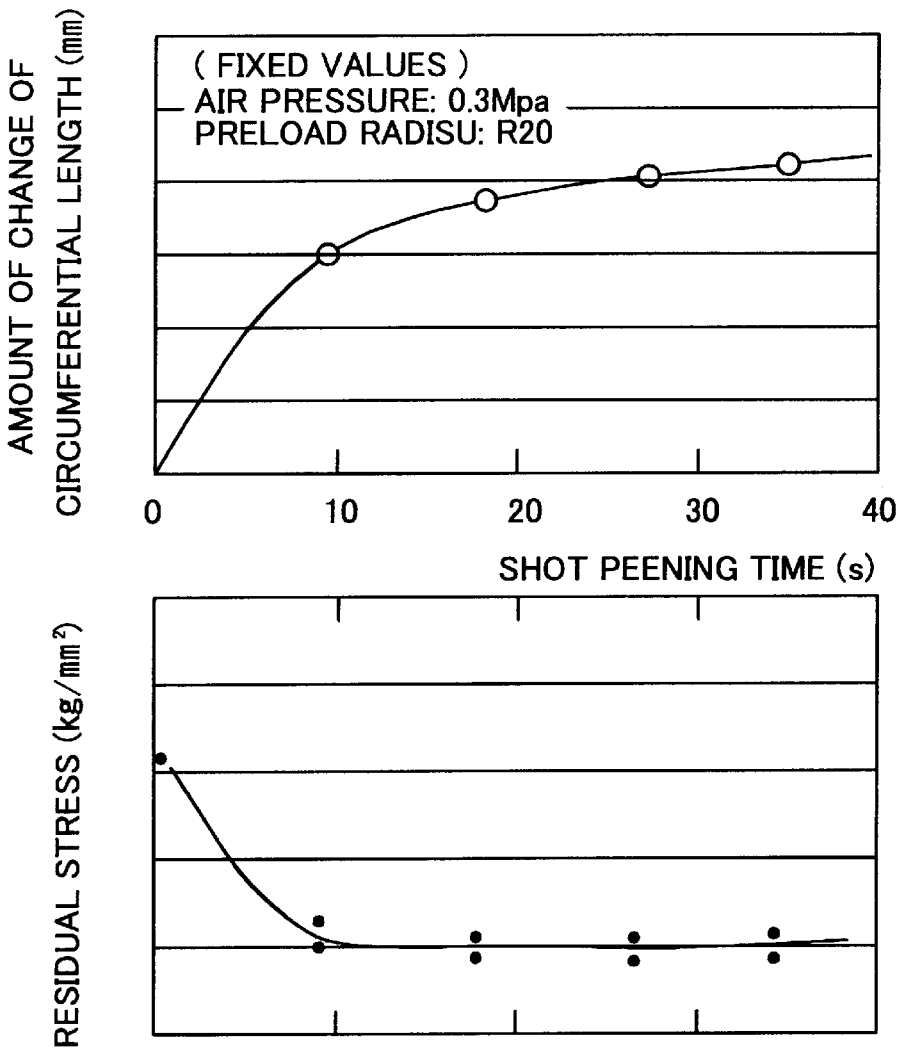
FIG. 4 is a graph illustrating changes of the circumferential length and residual stress of the endless metallic belt, according to the method of manufacturing the belt in the first and second embodiments.

While the variation of the circumferential length of the belt 6, due to the shot peening treatment, is in a range of about 0.1–0.2%, the rate of increase of the circumferential length tends to gradually decrease as the shot peening treatment is continued under the constant condition, as indicated in FIG. 4. By determining the shot peening time within a range in which the rate of increase is relatively low, the circumferential length can be finely adjusted to 0.02% or lower. Specifically, the amount of change of the circumferential length of the endless metallic belt 6 due to the shot peening treatment is about 1–3 mm, and the circumferential length increases with an increase in the shot peening time, while the rate of increase of the circumferential length tends to decrease with the shot peening time, as indicated in FIG. 4. The rate of increase of the circumferential length is comparatively low after about nine seconds have passed after the moment of initiation of the shot peening treatment. That is, the rate of increase is not higher than 0.02% if the shot peening time is suitably selected to be about nine seconds or longer, so that the circumferential length can be finely adjusted.

On the other hand, an increase of the residual compressive stress applied to the surface of the endless metallic belt 6 is saturated at a relatively early point of time during the shot peening treatment (about nine seconds after the moment of initiation of the shot peening treatment, in the example of FIG. 4). It was thus found that the fatigue strength of the belt 6 which has a high degree of correlation with the residual compressive stress can be sufficiently increased by a shot peening treatment for a comparatively short time. The minus sign preceding the value of the residual stress in the graph of FIG. 4 indicates that the residual stress is a compressive stress. It is also noted that the residual compressive stress of 200 $kg/mm^2$ is sufficient to effectively improve the fatigue strength of the belt 6.

From the standpoint of increasing the fatigue strength of the belt 6 by the shot peening treatment, it is reasonable to minimize the shot peening time while assuring the desired fatigue strength. According to the present invention, however, the tendency of gradual reduction of the rate of increase of the circumferential length of the belt 6 is taken into account in determining the shot peening time. That is, the shot peening treatment is continued even after the point of time at which the sufficient fatigue strength is obtained, and is terminated at a suitable point of time at which the rate of increase of the circumferential length is sufficiently low. This arrangement permits a fine adjustment of the circumferential length of the belt 6, without reducing the fatigue strength of the belt 6.

Figure 5:
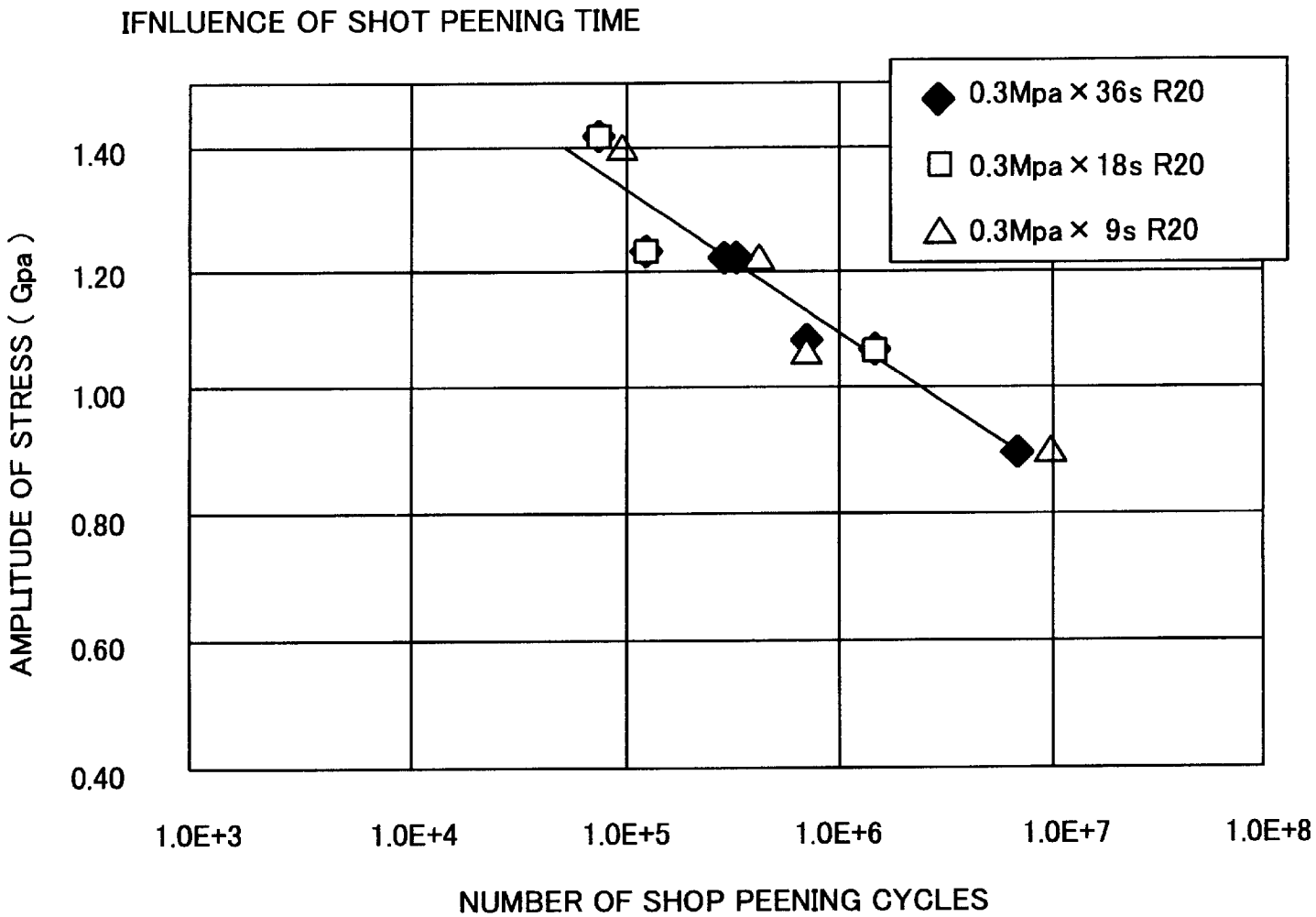
FIG. 5 is a graph illustrating relationships between the amplitude of the stress and the number of repetitions, when the endless metallic belt was subjected to shot peening treatments for different times in the method of manufacture in the first and second embodiments.

The graph of FIG. 5 shows that a line representing a fatigue characteristic of the belt 6 is almost the same for the shot peening times of 9 seconds, 18 seconds and 36 seconds. Where the shot peening time is about 9 seconds or longer, the shot peening time has substantially no influence on the fatigue strength of the belt 6. Namely, after the increase of the residual compressive stress is saturated, the fatigue strength of the belt 6 does not change with the shot peening time.

The residual compressive stress applied to the surface of the belt 6 by the shot peening treatment assures a stable increase of the fatigue strength of the belt 6, and a stable elongation of the belt 6 in the circumferential direction.

Generally, a treatment such as a nitriding or soft nitriding treatment or other surface hardening treatment to strengthen a material causes the material to become brittle as well as hardened. Accordingly, when the material strengthened by the surface hardening treatment is subjected to a tensile stress that induces tensile deformation, the material relatively easily undergoes cracking at minute pits and projections at the surface portion, or at a brittle grain boundary, or fracture at the weakest portion even with a small amount of strain. However, the material strengthened by the surface hardening treatment is more resistant at such defective surface portion to a compressive stress, than to a tensile stress, capable of exhibiting its original strength.

The elongation of the belt 6 in the circumferential direction by the ejection of the shot peening particles is induced as a Poison effect with respect to compressive plastic deformation. The shot peening treatment causes uniform and continuous local compressive plastic deformation of the belt 6, thereby permitting stable elongation of the belt 6 in the circumferential direction without cracking.

Exemplary features of the first and second embodiments of this invention will next be described in accordance with the invention.

In the first embodiment of this invention, the circumferential length of the endless metallic belt 6 was measured prior to the shot peening treatment. The condition of a shot peening treatment was determined on the basis of a subsequent measured circumferential length, such that an adjusted circumferential length of the belt 6 could be adjusted.

Thirty specimen pieces of the endless metallic belt 6 having the specifications described above were prepared. In a first comparative example, prior to the shot peening treatment, the specimen pieces had variations of about ±150 $\mu$m of their circumferential length (variations of 0.021% with respect to the average value of 720 mm, and a standard deviation of 50 $\mu$m), due to the nitriding treatment (to form a nitrided layer having a thickness of about 25 $\mu$m). The desired amount of increase of the circumferential length which was to be achieved by the shot peening treatment for establishing the desired circumferential length of the belt 6 as the end product could be calculated on the basis of the measured circumferential length of the belt 6 prior to the shot peening treatment. Based on the calculated amount of increase of the circumferential length, the desired shot peening time was obtained within a range of 18–36 seconds, according to the relationship, as shown in the graph of FIG. 4, between the amount of increase of the circumferential length and the shot peening time. The shot peening treatment is performed throughout the predetermined time, so that the circumferential length of the belt 6 can be finely adjusted to the desired value. Another condition of the shot peening treatment to be performed for each of the inner and outer circumferential surfaces of the belt 6 is as follows:

Preloading radius of curvature R: 20 mm

Ejection air pressure: 0.3 Mpa

Diameter of shot peening particles: 70 $\mu$m

Hardness of shot peening particles: HV700

As a result of the shot peening treatment, the variation of the circumferential length could be reduced to ±51 $\mu$m (about 0.007% of the average value, and a standard deviation of 17 $\mu$m), namely to about ⅓ of the variation of the first comparative example.

To adjust the circumferential length, not only the shot peening time but also other conditions, such as, the ejection air pressure or amount of the shot peening particles can be adjusted. However, since the rate of increase of the circumferential length nine seconds after the moment of initiation of the shot peening treatment is low, the adjustment of the circumferential length by adjusting the shot peening time is comparatively easy. In this respect, it is preferable to adjust the shot peening time.

In accordance with the second embodiment of this invention, the circumferential length of the endless metallic belt 6 was measured during the shot peening treatment, and the shot peening treatment was terminated at a point of time determined on the basis of the measured circumferential length, so that the circumferential length of the belt 6 was adjusted.

In the first embodiment, the variation of the circumferential length of the belt 6 after the shot peening treatment was reduced to ⅓ of that of the first comparative example, but was not completely eliminated. This variation of the circumferential length after the shot peening treatment is due to the variation of the circumferential length prior to the shot peening treatment, and due to a variation of the shot peening condition.

To further reduce the variation, in the second embodiment, the circumferential length was continuously measured during the shot peening treatment, and the shot peening treatment was terminated when the measured length reached the desired value. The specimen pieces of the belt 6 prior to the shot peening treatment were the same as those in the first embodiment. The shot peening condition in the second embodiment was the same as in the first embodiment, except for the continuous measurement of the circumferential length and the termination of the shot peening treatment when the desired circumferential length was measured. The shot peening treatment was continued for at least nine seconds, and was terminated when the measured circumferential length reached the desired value. The circumferential length of the belt 6 obtained by treating each of the thirty specimen pieces was measured by a measuring instrument.

The measurement indicated that the variation of the circumferential length after the shot peening treatment was reduced to about ±30 μm (about 0.004% of the average value, and a standard deviation of 10 μm). Thus, the endless metallic belt 6 could be manufactured such that the variation of the circumferential length was reduced to about ⅕ or smaller of that of the first comparative example The second embodiment is adapted to measure the circumferential length of the belt 6 during the shot peening treatment, and determine the moment of termination of the shot peening treatment on the basis of the measured circumferential length. Therefore, the final circumferential length of the treated belt 6 is not influenced by the nitriding or soft nitriding treatment prior to the shot peening treatment, so that the accuracy of the circumferential length in the second embodiment can be improved over that in the first embodiment. During the shot peening treatment, the circumferential length of the belt is measured by the measuring instrument which includes the arm 9 and the dial indicator 8 described above.

The circumferential length of the endless metallic belt 6 manufactured by the method according to the first embodiment may be finely adjusted by the shot peening treatment according to the second embodiment. In this case, the fatigue strength of the endless metallic belt 6 manufactured by the method according to the first embodiment has been improved, so that the time duration of the shot peening treatment according to the second embodiment may be nine seconds or shorter.

In the first and second embodiments, the circumferential length of the belt 6 is adjusted by the shot peening treatment. It is noted, however, that the shot peening treatment has the following characteristic:

The condition in which the shot peening particles 15 are ejected is unstable in the initial and terminal portion of the shot peening cycle, regarding the ejection velocity and the density of the shot peening particles 15. For instance, the ejection condition is unstable in the initial portion of the shot peening cycle, since the shot peening particles 15 used in the last cycle are left in the ejection nozzles. Where the ejection mechanism is of air blow type, in particular, the ratio of the volume of the shot peening particles 15 and the air with respect to each other is not stable. Accordingly, the ejection velocity of the shot peening particles 15 is influenced and fluctuates. This fluctuation is not a concern where an article to be subjected to a shot peening treatment has a relatively large thickness, for instance, where ordinary gears are subjected to the shot peening treatment. On the other hand, a metallic belt such as the endless metallic belt 6 described above has a relatively small thickness and is considerably easily deformed. Therefore, a variation of the ejection intensity tends to cause local deterioration of the geometrical and dimensional accuracies of the belt, where the shot peening treatment is effected while the belt is rotated.

To assure a high degree of geometrical and dimensional accuracies of the endless metallic belt 6 described above, it is desirable to perform a uniform shot peening operation over the entire circumferential length of the belt. The geometrical and dimensional accuracies in the circumferential direction are influenced by a variation or fluctuation in the condition of ejection of the shot peening particles 15 and a variation or fluctuation of the rotating speed of the belt. If the endless metallic belt 6 slips on the drive roller, local portions of the belt 6 are subjected to intense ejection of the shot peening particles 15, so that the accuracies have considerable variations in the circumferential direction.

The third through fifth embodiments of this invention are arranged to prevent intense ejection of the shot peening particles 15 in local circumferential portions of the belt.

The method and apparatus for manufacturing an endless metallic belt according to the third and fourth embodiments are adapted to deal with the fluctuation of the ejecting condition of the shot peening particles 15, while the method and apparatus according to the fifth embodiment is adapted to deal with the fluctuation of the rotating speed of the belt.

Figure 7:
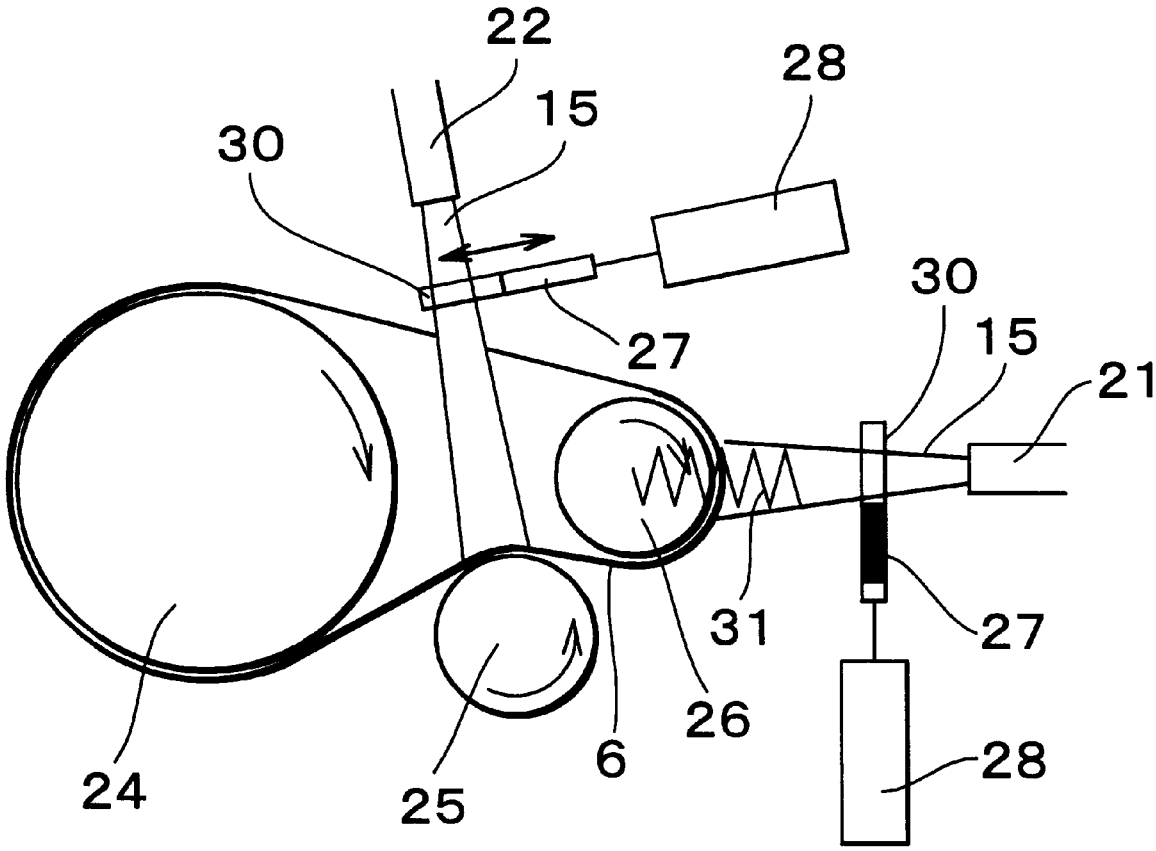
FIG. 7 illustrates a side elevational view (a plan view) of an apparatus for manufacturing an endless metallic belt according to a third embodiment of this invention.

As shown in FIG. 7, the apparatus according to the third embodiment includes ejection nozzles 21, 22, a drive roller 24, driven rollers 25, 26 and a spring 31, which are similar to the ejection nozzles 4,5, drive roller 1, driven rollers 2, 3 and spring 11 which have been described with respect to the first embodiment. The apparatus further includes a blocking mechanism or means for preventing the shot peening particles 15 ejected from the ejection nozzles 21, 22, from striking the endless metallic belt 6, while the condition of ejection of the shot peening particles 15 is unstable. In the present third embodiment, the path of movement of the shot peening particles 15 extends between each ejection nozzle 21, 22 and the belt 6, through a window 30. This window 30 is selectively opened and closed by the blocking mechanism, which includes a shutter 27 in the form of a plate and an air cylinder 28. The shutter 27 is disposed in front of the corresponding ejection nozzle 21, 22 as viewed in the ejecting direction of the shot peening particles 15. The air cylinder 28 is operated under the control of an electrically controlled solenoid-operated control valve (not shown), for example, to move the shutter 27 between open and closed positions for selectively opening and closing the window 30. The air cylinder 28 for opening and closing the window 30 may be replaced by an electric motor. The shutter 27 is placed in the closed position for closing the window 30 to block the ejected shot peening particles 15 in the initial and terminal portions of the shot peening cycle. For example, where the shot peening particles 15 are ejected from the ejection nozzles 21, 22 for a total time of 32 seconds in each shot peening cycle, the shutter 27 is held in the closed position to close the window 30 for four seconds after the moment of initiation of the ejection of the shot peening particles 15 (initiation of the cycle), to prevent the ejected shot peening particles 15 from striking the belt 6. Four seconds after the moment of initiation of the ejection of the shot peening particles 15, the shutter 27 is moved to the open position and is held in this open position for twenty-seven seconds to open the window 30 and permit the ejected shot peening particles 15 to strike the belt 6. When twenty-seven seconds have passed with the shutter 27 held in the open position, the shutter 27 is moved to the closed position to close the window 30. The ejection of the shot peening particles 15 is terminated one second after the window 30 has been closed.

Figure 8:
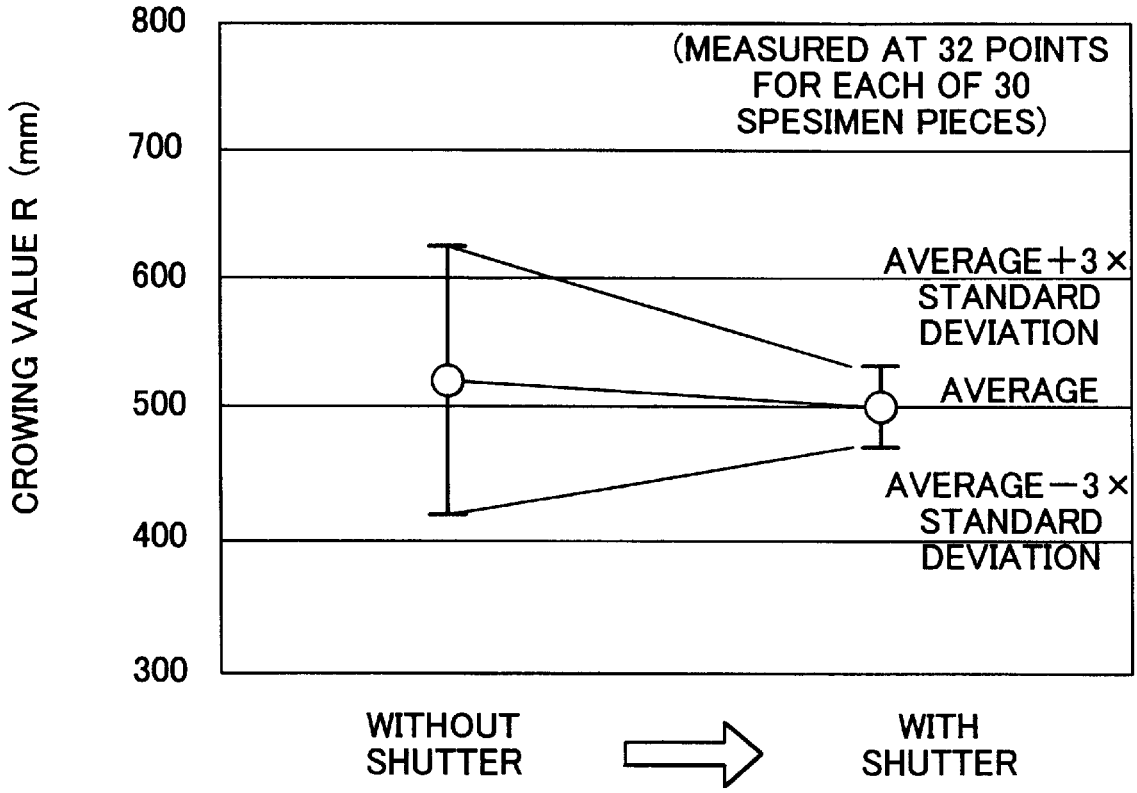
FIG. 8 is a graph illustrating a difference between variations of the crowing value R of the endless metallic belt where a shutter is present and absent, respectively, when the belt is treated by the apparatus according to the third embodiment of this invention.

According to the method of the third embodiment, thirty specimen pieces of the belt 6 were subjected to the shot peening treatment to obtain the end products according to the present invention. And, thirty pieces of the belt 6 were subjected to the shot peening treatment under the same condition as in the third embodiment, except for the ejection of the shot peening particles 15 for twenty-seven seconds without using the shutter 27, to obtain the end products according to a second comparative example. To check a variation of the crowing value R of each end product, the crowing value R was measured at thirty-two points which are equally spaced apart from each other in the circumferential direction of the belt 6. A result of the measurement is indicated in FIG. 8. As is apparent from FIG. 8, the accuracy of the crowing value R of the end products according to the present invention is considerably higher than that of the end products according to the second comparative example. Namely, the variation of the crowing value R of the end products according to the present invention was reduced to about ⅓ of that of the second comparative example.

As described above, the apparatus for manufacturing the endless metallic belt 6 according to the third embodiment includes the blocking mechanism which serves as a shut-off device or means operable to prevent the shot peening particles 15 ejected from the ejection nozzles 21, 22, from striking the endless metallic belt 6. That is, the shut-off device provided in the third embodiment includes the shutter 27 which is moved to the open and closed positions for selectively opening and closing the window 30, to selectively permit and inhibit the ejection of the shot peening particles 15 against the belt. The shutter used in the shut-off device need not take the form of a plate. Further, the shutter need not be arranged to have a linear motion between the open and closed positions, but may be arranged to have a rotary motion between two positions for selectively and permitting and inhibiting the ejection of the shot peening particles 15 against the endless metallic belt.

Figure 9:
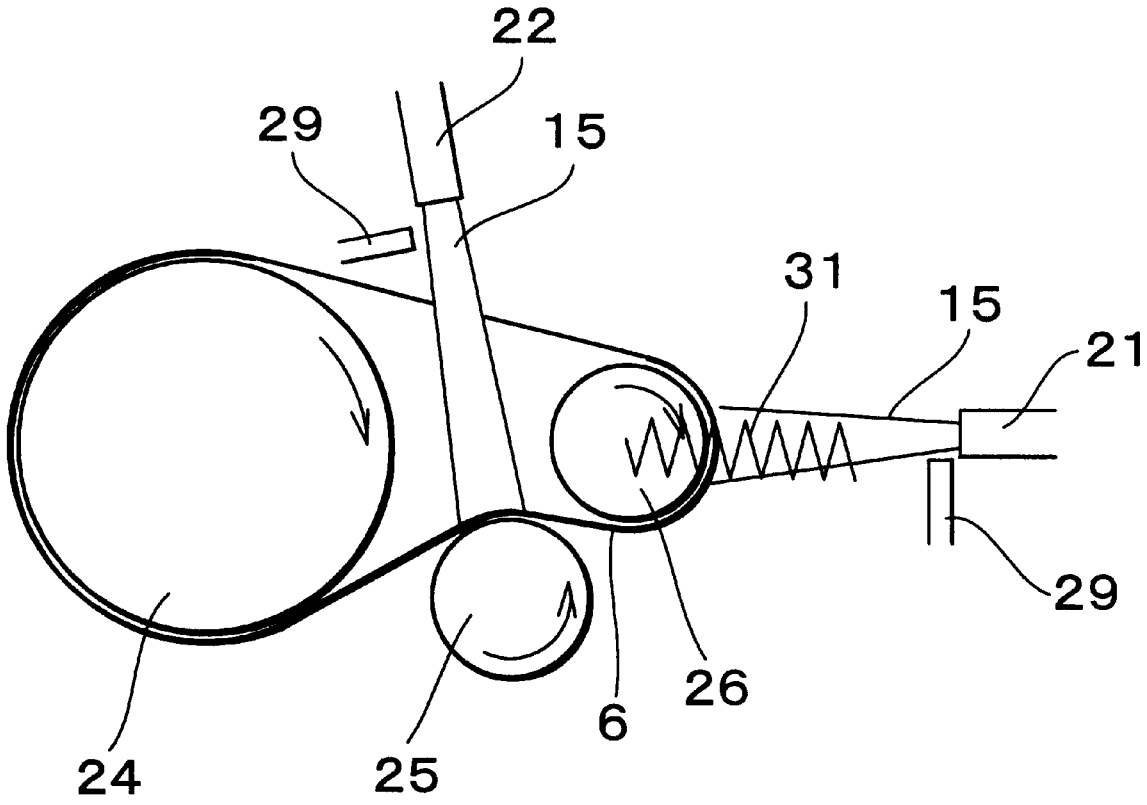
FIG. 9 illustrates a side elevational view (a plan view) of an apparatus for manufacturing an endless metallic belt according to the fourth embodiment of this invention.

The apparatus shown in FIG. 9 for manufacturing the endless metallic belt according to a fourth embodiment also includes a blocking mechanism for each of the ejection nozzles 21, 22, for inhibiting the ejection of the shot peening particles 15 against the endless metallic belt 6 while the condition of ejection of the shot peening particles 15 is unstable. Specifically, the apparatus according to the fourth embodiment includes the blocking mechanism in the form of a path-changing device (or path-changing means) operable to deflect or change the path of movement of the shot peening particles 15 such that the shot peening particles 15 do not reach the belt 6. The path-changing device consists of an air blow nozzle 29 which is disposed downstream of the ejection nozzle 21, 22 and which is arranged to eject a fluid, e.g., air, along a path which intersects the path of movement of the shot peening particles 15. Air is ejected from the air blow nozzle 29, to deflect the path of movement of the shot peening particles 15 to prevent the shot peening particles 15 from striking the belt 6, while the condition of ejection of the shot peening particles 15 is not stable.

In the initial and terminal portions of each shot peening cycle, the path of movement of the shot peening particles 15 is deflected by the air ejected from the air blow nozzles 29 so that the ejected shot peening particles 15 do not strike the belt 6. For example, where the shot peening particles 15 are ejected from the ejection nozzles 21, 22 for a total time of thirty-two seconds in each shot peening cycle, the air is ejected from the air blow nozzles 29 for four seconds after the moment of initiation of the ejection of the shot peening particles 15 (initiation of the cycle), to prevent the ejected shot peening particles 15 from striking the belt 6. Four seconds after the moment of initiation of the ejection of the shot peening particles 15, the ejection of the air from the air blow nozzles 29 is terminated, to permit the ejected particles 15 to strike the belt 6 for twenty-seven seconds. When twenty-seven seconds have passed in the absence of the air, the ejection of the air from the air blow nozzles 29 is resumed.

To obtain the results according to the present invention, thirty specimen pieces of the belt 6 were subjected to the shot peening treatment according to the method of the fourth embodiment. And, thirty pieces of the belt 6 were subjected to the shot peening treatment under the same condition as in the fourth embodiment, except for the ejection of the shot peening particles 15 for twenty-seven seconds without using the shutter 27, to obtain the end products according to a third comparative example. To check a variation of the crowing value R of each end product, the crowing value R was measured at thirty-two points which are equally spaced apart from each other in the circumferential direction of the belt 6. A result of the measurement is similar to that of FIG. 8, and the accuracy of the crowing value R of the end products according to the present invention was considerably higher than that of the end products according to the third comparative example. Namely, the variation of the crowing value R of the end products according to the present invention was reduced to about ⅓ of that of the third comparative example.

While the apparatus according to the third embodiment suffers from frictional wear of the shutter 27 due to contact with the shot peening particles 15, the apparatus according to the fourth embodiment does not have such a problem. In addition, the blocking mechanism of the fourth embodiment is simpler in construction and does not include a movable member, such as the air cylinder 28 used in the third embodiment. Therefore, the blocking mechanism is free from contamination by the shot peening particles 15.

As described above, the apparatus according to the third and fourth embodiments are provided with the blocking mechanism for preventing the shot peening particles 15 ejected from the ejection nozzles 21, 22, from striking the endless metallic belt 6, until the shot peening intensity defined by the ejection velocity and density of the shot peening particles 15 has become stabilized. Thus, the blocking mechanism is effective to avoid a variation or fluctuation in the shot peening intensity during the shot peening cycle, thereby making it possible to reduce a variation of the geometrical and dimensional accuracies of the endless metallic belt 6. Therefore, the reliability of the accuracies of the belt is improved.

The blocking mechanism for preventing the shot peening particles 15, ejected from the ejection nozzles 21, 22, from striking the endless metallic belt may include a solid member capable of blocking the shot peening particles 15 as shown in the third embodiment, or eject a fluid (e.g., air) capable of deflecting a path of the shot peening particles 15 as shown in the fourth embodiment.

Figure 10:
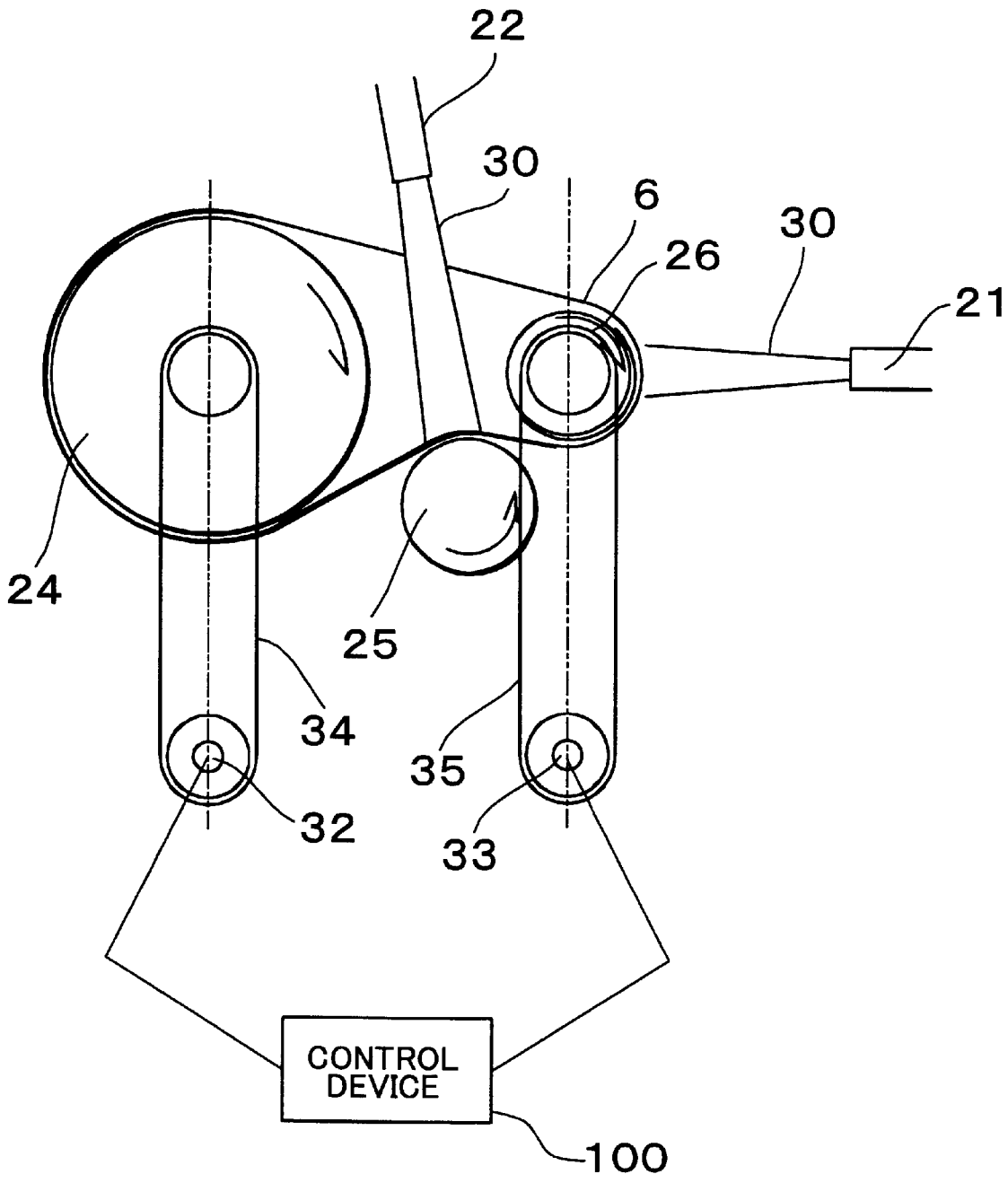
FIG. 10 illustrates a side elevational view (a plan view) of an apparatus for manufacturing an endless metallic belt according to a fifth embodiment of this invention.

FIG. 10 illustrates a fifth embodiment in accordance with the invention. The fifth embodiment employs detectors 32, 33 (detecting means) that detect slipping of the endless metallic belt 6 on the drive roller 24, and on the first driven roller 26. The detectors 32, 33 are encoders connected to the drive shafts of the respective drive and driven rollers 24, 26, through respective grooved belts 34, 45. The rotating speeds of the drive roller 24 and the driven roller 26 are represented by electric output signals from the encoders 32, 33. The detectors 32, 33 are connected to a control device 100 (or controller), so that the output signals of the encoders are processed by the control device 100 to continuously calculate the rotating speeds of the driver roller 24 and the driven roller 26. In the absence of slipping of the belt 6 on the drive roller 24 the rotating speed of the drive roller 24 detected by the detector 32 corresponds to the rotating speed of the belt 6.

The rotating speed of the belt 6 can be calculated on the basis of the rotating speed of the drive roller 24 and the diameter of the drive roller 24. If the slipping of the belt 6 on the drive roller 24 occurs, the rotating speed of the belt 6 as calculated on the basis of the rotating speed of the driven roller 26 (represented by the output signal of the detector 33) and the diameter of the driven roller 26 is lower than the rotating speed. If the rotating speed of the belt 6 as calculated on the basis of the output signal of the detector 33 is lower than the rotating speed by more than a predetermined threshold amount, the control device 100 determines that the belt 6 is slipping on the drive roller 24, generates an alarm signal and interrupts the shot peening treatment. In accordance with the invention, "interrupt" can be interpreted to include "discontinue."

In this exemplary fifth embodiment, the above-indicated threshold amount is determined to be 1% of the rotating speed of the belt 1, taking into account the measuring errors of the detectors 32, 33. The detector 32 for detecting the rotating speed of the drive roller 24 is not essential and can be eliminated such that the rotating speed of the servomotor for driving the drive roller 24 can be accurately controlled so as to hold the rotating speed of the drive roller 24 (corresponding to the rotating speed of the belt). In this case, the rotating speed of the belt 6 as calculated on the basis of the output signal of the detector 33 is compared with the known rotating speed of the belt 6. The detectors 32, 34, in the form of the encoders, may be replaced by other rotary speed sensors such as, tachometer generators according to a predetermined threshold accuracy. While in the present embodiment, the drive roller 24 and the first driven roller 26 are connected to the detectors 32, 33 through the grooved belts 34, 35, the detectors may also be provided for the second driven roller 25 or the first and second driven rollers 25, 26, as well as for the drive roller 24.

According to the fifth embodiment of this invention, specimen pieces of the endless metallic belt 6 were subjected to the shot peening treatment and the accuracy of the circumferential length of each specimen piece was observed. In the shot peening treatment, the ejection of the shot peening particles 15 was continued for twenty-seven seconds in each cycle. The accuracy of the circumferential length between the case where the shot peening treatment is controlled according to the output signals of the detectors 32, 33 and the case where the shot peening treatment is not controlled according to the output signals of the detectors 32, 33 was compared to determine a difference. A control program normally executed by the control device 100 to control the shot peening treatment according to the fifth embodiment was modified so as to merely generate the alarm signal but not to turn off the servomotor for the drive roller 24 and not to terminate the shot peening cycle even if the control device determines that slipping of the belt 6 occurs on the drive roller. The measured circumferential lengths of the specimen pieces which suffered from the slipping of the belt were compared with those of the specimen pieces which did not suffer from the slipping of the belt.

About 1% of the specimen pieces suffered from the slipping of the belt, and were labeled as "defective end products," as distinguished from "normal end products" which did not suffer from the slipping of the belt. The circumferential length of each of the thirty defective end products, and the circumferential length of each of thirty products selected at random from among the normal end products were measured and compared with each other. A result of the measurement is indicated in FIG. 11.

Figure 11:
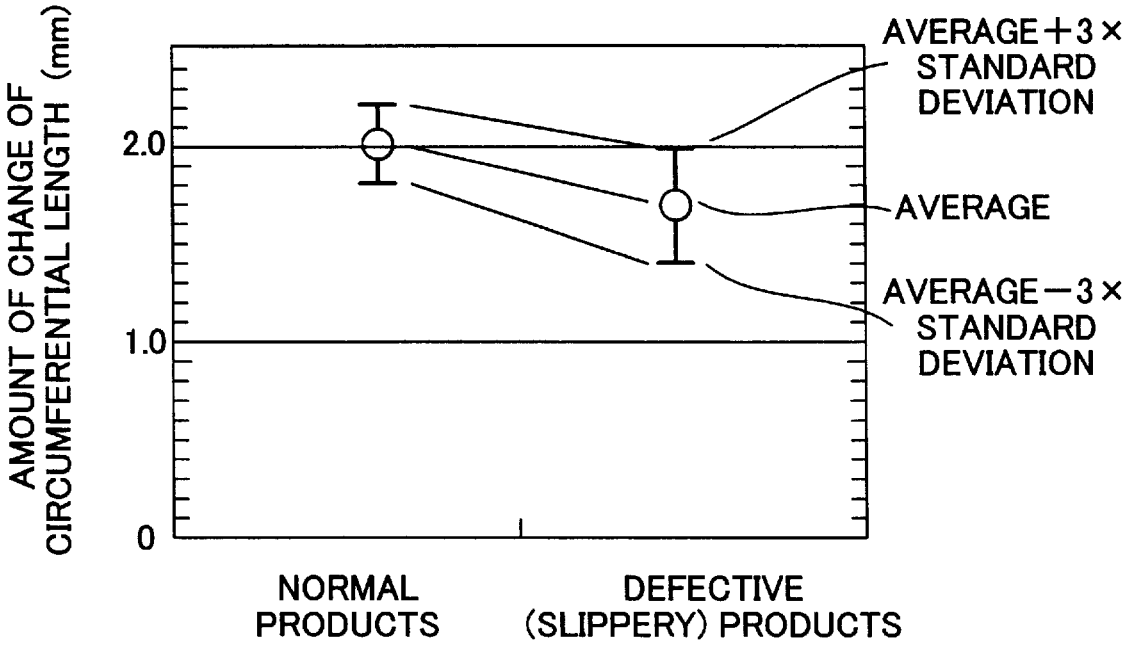
FIG. 11 illustrates a graph indicating a difference between the amounts of change of the circumferential length of the endless metallic belt where the belt treated by the apparatus is found normal and defective (slippery)
Figure 12:
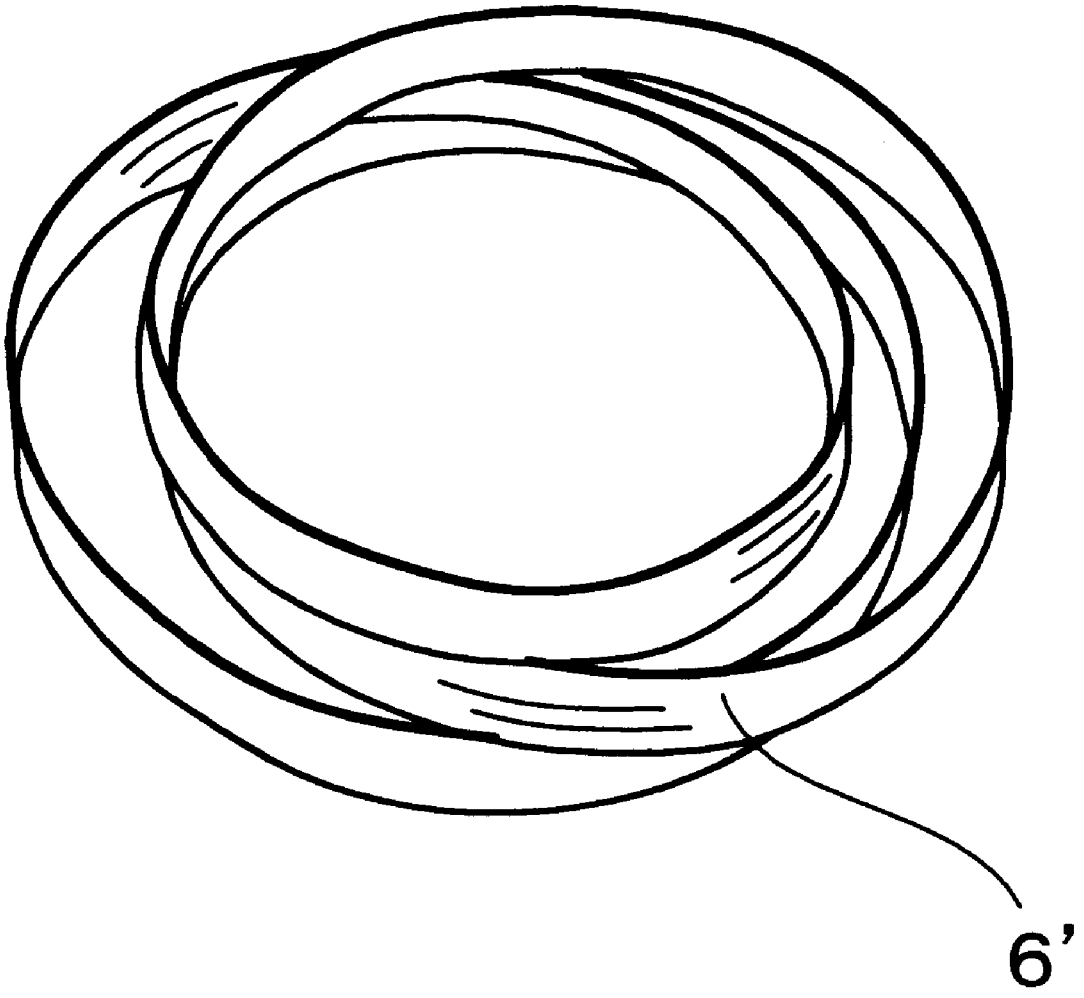
FIG. 12 illustrates an endless metallic belt deformed in a multiple-hoop state.

Referring to FIG. 11, the amount of increase of the circumferential length of the belt due to the shot peening treatment tends to be comparatively small where the slipping of the belt occurs, and the amount of variation of the circumferential length tends to be relatively large where the slipping of the belt occurs. In particular, the standard deviation of the circumferential length of the normal end products obtained according to the fifth embodiment using the output of the detectors 32, 33 to control the shot peening treatment was reduced by about 34% as compared with that of the defective end products which suffered from the slipping of the belt. Thus, the shot peening treatment controlled on the basis of the output signals of the output signals of the detectors 32, 33 contributes to an improvement in the accuracy of the circumferential length of the end products. Thus, the fifth embodiment makes it possible to eliminate the defective end products (or rectify the defective end products by subjecting them again to the shot peening treatment, where appropriate), so that the normal end products having a reduced amount of variation of the circumferential length can be obtained with high reliability. Further, the method according to the fifth embodiment permits uniform shot peening treatment over the entire circumferential length of the belt, assuring sufficiently high strength of the belt.

As described above, the apparatus according to the fifth embodiment includes detectors for detecting slipping of the endless metallic belt on the rollers, making it possible to deal with the slipping of the belt, which would cause a variation of the geometrical and dimensional accuracies of the belt due to unstable rotation of the belt during the shot peening treatment.

The endless metallic belt manufactured by any one of the methods according to the embodiments of the invention described above has a significantly high degree of dimensional accuracy, and can be used to form a high-quality end product in the form of a multi-layered belt (consisting of nine layers, for example). For instance, this multi-layered belt may be used for a continuously variable transmission provided in vehicles such as automobiles.

Another aspect of the invention according to the method of the first or second embodiment may be to combine at least one of the methods according to the third, fourth and fifth embodiments. Alternatively, it is a further aspect of the invention to combine the method of the first embodiment, the method of the second embodiment, the method of the third or fourth embodiment, and the method of the fifth embodiment.

In the illustrated embodiment, the control device 100 is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A method of manufacturing an endless metallic belt, comprising the steps of:

adjusting a condition of a shot peening treatment to adjust a circumferential length of the endless metallic belt;

applying the shot peening treatment to the endless metallic belt; and measuring the circumferential length of the endless metallic belt prior to applying the shot peening treatment, and wherein the adjusting step includes determining the condition of the shot peening treatment on the basis of the measured circumferential length.

2. The method according to claim 1, wherein the step of adjusting comprises adjusting a time of ejection of shot peening particles against the endless metallic belt during the shot peening treatment, on the basis of the measured circumferential length.

3. The method according to claim 1, further comprising a step of measuring the circumferential length of the endless metallic belt while the endless metallic belt is subjected to the shot peening treatment; and a second step of adjusting the condition of the shot peening treatment on the basis of the measured circumferential length during the shot peening treatment.

4. The method according to claim 3, wherein the second adjusting step comprises terminating the shot peening treatment when the measured circumferential length of the endless metallic belt is equal to a predetermined value.

5. The method according to claim 1, wherein the step of adjusting prevents shot peening particles from striking the endless metallic belt for a predetermined time after a moment of initiation of ejection of the shot peening particles.

6. The method according to claim 1, wherein the shot peening treatment is performed while the endless metallic belt is rotated so as to travel on a drive roller and a driven roller, the method further comprising:

detecting a slipping of the endless belt on at least one of the drive roller and the driven roller; and interrupting the shot peening treatment when the slipping of the endless metallic belt is detected.

7. An endless metallic belt manufactured by a method according to claim 1.

8. A method of manufacturing an endless metallic belt, comprising the steps of:

adjusting a condition of a shot peening treatment to adjust a circumferential length of the endless metallic belt;

applying the shot peening treatment to the endless metallic belt; and measuring the circumferential length of the endless metallic belt while the endless belt is subjected to the shot peening treatment, and wherein the adjusting step includes adjusting the shot peening treatment on the basis of the measured circumferential length.

9. The method according to claim 8, wherein the step of adjusting prevents shot peening particles from striking the endless metallic belt for a predetermined time after a moment of initiation of ejection of the shot peening particles.

10. The method according to claim 8, wherein the shot peening treatment is preformed while the endless metallic belt is rotated so as to travel on a drive roller and a driven roller, the method further comprising:

detecting a slipping of the endless belt on at least one of the drive roller and the driven roller; and interrupting the shot peening treatment when the slipping of the endless metallic belt is detected.

11. An endless metallic belt manufactured by a method according to claim 8.

12. The method according to claim 8, wherein the step of adjusting comprises terminating the shot peening treatment when the measured circumferential length of the endless metallic belt is equal to a predetermined value.

13. An apparatus for manufacturing an endless metallic belt, comprising:

at least two rollers upon which the endless metallic belt rotates in tension;

an ejection nozzle that ejects shot peening particles against the endless metallic belt during rotation of the endless metallic belt during a shot peening treatment; and an instrument that measures a change of a circumferential length of the endless metallic belt during the shot peening treatment.

14. An apparatus for manufacturing an endless metallic belt, comprising:

at least two rollers upon which the endless metallic belt rotates in tension;

an ejection nozzle that ejects shot peening particles against the metallic belt during rotation of the endless metallic belt during a shot peening treatment; and a blocking mechanism that prevents the shot peening particles from striking the endless metallic belt.

15. The apparatus according to claims 14, further comprising a controller that controls a condition of the shot peening treatment.

16. The apparatus according to claim 14, further comprising an instrument that measures a change of a circumferential length of the endless metallic belt during the shot peening treatment.

17. The apparatus according to claims 14, wherein the blocking mechanism includes a shut-off device that prevents the ejected shot peening particles from striking the endless metallic belt.

18. The apparatus according to claim 14, wherein the blocking mechanism includes a path-changing device that changes a path of movement of the shot peening particles such that the shot peening particles do not reach the endless metallic belt.

19. The apparatus according to claim 14, wherein the blocking mechanism prevents the shot peening particles from striking the endless metallic belt for a predetermined time after a moment of initiation of ejection of the shot peening particles from the ejection nozzle.

20. An apparatus for manufacturing an endless metallic belt, comprising:

at least two rollers upon which the endless metallic belt rotates in tension;

an ejection nozzle that ejects shot peening particles against the metallic belt during rotation of the endless metallic belt during a shot peening treatment; and a detector that detects a slipping of the endless metallic belt on at least one of the two rollers.

21. The apparatus according to claim 20, wherein the at least two rollers include a drive roller and a driven roller, and wherein the detector detects the slipping of the endless belt on at least one of the drive roller and the driven roller, on the basis of rotating speeds of the drive roller and the driven roller.

22. The apparatus according to claim 20, further comprising a control device that interrupts the shot peening treatment when the slipping of the endless belt is detected by the detector.

* * * * *